US006220371B1

(12) United States Patent
Sharma et al.

(10) Patent No.: US 6,220,371 B1
(45) Date of Patent: Apr. 24, 2001

(54) DOWNHOLE IN-SITU MEASUREMENT OF PHYSICAL AND OR CHEMICAL PROPERTIES INCLUDING FLUID SATURATIONS OF CORES WHILE CORING

(75) Inventors: Mukul M. Sharma; Roger T. Bonnecaze; Bernard Zemel, all of Austin, TX (US)

(73) Assignee: Advanced Coring Technology, Inc., Austin, TX (US)

( * ) Notice: Subject to any disclaimer, the term of this patent is extended or adjusted under 35 U.S.C. 154(b) by 0 days.

(21) Appl. No.: 09/383,495

(22) Filed: Aug. 26, 1999

Related U.S. Application Data

(63) Continuation of application No. 08/898,269, filed on Jul. 22, 1997, now Pat. No. 6,003,620
(60) Provisional application No. 60/022,662, filed on Jul. 26, 1996.

(51) Int. Cl.[7] ..... E21B 49/02; E21B 47/00
(52) U.S. Cl. ..... 175/50; 73/152.46; 175/40; 175/58
(58) Field of Search ..... 73/152.46, 152.03, 73/152.07, 152.09, 152.11, 868.44; 175/40, 44, 50, 58

(56) References Cited

U.S. PATENT DOCUMENTS

| | | |
|---|---|---|
| 2,820,610 | 1/1958 | Martinez . |
| 3,183,983 | 5/1965 | Vogel . |
| 3,901,075 | 8/1975 | Hampton et al. . |
| 4,492,275 | 1/1985 | Campbell et al. . |

(List continued on next page.)

OTHER PUBLICATIONS

Murphy, David Patrick, "What's New in MWD and Formation Evaluation," World Oil, May 1993, pp. 47–52.

Murphy, David Patrick, "Advances in MWD and Formation Evaluation for 1995," World Oil, Mar. 1995, pp. 39–49.

Bradburn and Cheatham, "Improved Core Recovery in Laminated Sand and Shale Sequences," Journal of Petroleum Technology, Dec. 1988, pp. 1544–1546.

Brown and Marriott, "Use of Tracers to Investigate Drilling Fluid Invasion and Oil Flushing While Coring," Society of Petroleum Engineers 16352, Proceedings of 57th Annual California Regional Meeting, Apr. 8–10, 1987, 311–318.

Putz, Morineau and Begani, Gamma Ray Absorption Measurements, Laboratory Experiments in Bottomhole Conditions,: Society of Petroleum Engineers 26621, 1993 SPE Annual Technical Conference, Oct. 3–6, 1993, pp. 127–139.

(List continued on next page.)

*Primary Examiner*—Robert E. Pezzuto
(74) *Attorney, Agent, or Firm*—Strasburger & Price, LLP

(57) ABSTRACT

The present invention is a method and apparatus for real time in-situ measuring of the downhole chemical and or physical properties of a core of an earth formation during a coring operation. The present invention comprises several embodiments that may use electromagnetic, acoustic, fluid and differential pressure, temperature, gamma and x-ray, neutron radiation, nuclear magnetic resonance, and mudwater invasion measurements to measure the chemical and or physical properties of the core that may include porosity, bulk density, mineralogy, and fluid saturations. The present invention comprises a downhole apparatus coupled to an inner and or an outer core barrel near the coring bits with a sensor array coupled to the inner core barrel for real time gathering of the measurements. A controller coupled to the sensor array controls the gathering of the measurements and stores the measurements in a measurement storage unit coupled to the controller for retrieval by a computing device for tomographic analysis.

34 Claims, 12 Drawing Sheets

U.S. PATENT DOCUMENTS

| | | |
|---|---|---|
| 4,499,955 | 2/1985 | Campbell et al. . |
| 4,499,956 | 2/1985 | Campbell et al. . |
| 4,601,354 | 7/1986 | Campbell et al. . |
| 4,735,269 | 4/1988 | Park et al. . |
| 4,765,414 | 8/1988 | Moore . |
| 4,955,438 | 9/1990 | Juergens et al. . |
| 4,996,872 | 3/1991 | Mueller et al. . |
| 5,010,765 | 4/1991 | Duckworth et al. . |
| 5,109,398 | 4/1992 | Hunt et al. . |
| 5,359,194 | 10/1994 | Moss . |
| 5,568,838 | 10/1996 | Struthers et al. . |

OTHER PUBLICATIONS

Gatens III, Harrison III, Lancaster, and Guidry, "In–Situ Stress Tests and Acoustic Logs Determine Mechanical Properties and Stress Profiles in the Dovonian Shales," SPE Formation Evaluation, Sep. 1990, pp. 248–254.

Marsala, Zausa, Martera, and Santarelli, "Sonic While Drilling: Have you Thought About Cuttings?," Society of Petroleum Engineers 30545, 1995 SPE Annual Technical Conference, Oct. 22–25, 1995, pp. 127–136.

Saha, Al–Kaabi, Amabeoku and Al–Fossail, "Core–Log Integration for a Saudi Arabian Sandstone Reservoir," Society of Petroleum Engineers 29867, Proceedings of the Middle East Oil Show in Bahrain, Saudi Arabia, Mar. 11–14, 1995, pp. 293–309.

"Technologies for Measurement While Drilling," Proceedings of a Symposium Held at Washington, DC on Oct. 22–23, 1981, Sponsor: National Science Foundation.

Relative Resistivity: .830-high
.024-low

DOWNHOLE IN-SITU MEASUREMENT OF PHYSICAL AND OR CHEMICAL PROPERTIES INCLUDING FLUID SATURATIONS OF CORES WHILE CORING

This application is a continuation of the earlier filed U.S. pat. app. Ser. No. 08/898269, filed Jul. 22, 1997 (22.07.1997), now U.S. Pat. No. 6,003,620, which is a continuation in part of provisional application Ser. No. 60/022,662, filed Jul. 26, 1996, which are both incorporated by reference for all purposes into this application.

BACKGROUND OF THE INVENTION

1. Field of the Invention

The present invention relates generally to the field of subterranean formation evaluation during well coring operations. More specifically, this invention relates to measurement while coring techniques for the real time in-situ measurement of the chemical and or physical properties of a core during coring operations.

2. Description of the Related Art

Coring operations occur during the drilling of oil, gas, and water wells to recover parts of the subterranean earth formation (a core) for analysis of the chemical properties, physical properties, and or fluid saturations of the core within the earth formation. The downhole assembly for a coring operation generally comprises a coring bit, an inner and outer core barrel, and one or more stabilizers that provide weight on the core bit and stability to the entire downhole assembly during operation. As the coring proceeds, the coring operator periodically brings the inner core barrel, which also serves as a container for the core downhole, to the surface (a "trip") to remove the core for analysis at the surface.

When bringing the core from the bottom of the well hole to the surface, significant pressure and temperature changes occur that result in gas expansion as well as the evolution of gas from the oil. During this de-pressurization (the bringing to the surface) the chemical and or the physical properties of the core including the fluid saturations undergo a substantial change, which means that the analysis of the core at the surface will have some amount of error because of this change in the core from its down hole state. Pressure coring and Sponge Barrel coring are techniques used in the past to avoid the above problems. However, the use of these techniques is somewhat rare due to the expense involved in their use.

Another technique is to add mudwater tracers to the drilling mud to account for changes in the fluid saturation of the core due to flushing by the mud filtrate, depressurization, and other processes. The addition of the mudwater tracers to the drilling mud occurs at the surface, which allows the tracers to "invade" the core during the coring process. When recovered at the surface, the analysis of the core requires radially sectioning of the core, extraction, and searching for the tracer to monitor the mudwater invasion. This analysis technique is both time consuming and expensive and still may not provide accurate measurements as noted above, especially if the core contains the three fluid phases present in it. Another disadvantage of this technique is that it does not correct for any changes in the porosity of the rock.

Due to the high cost of coring, most chemical and or physical information about the subterranean earth formation comes from wireline downhole well logging. This method for measurement gathering involves lowering a measurement device attached to a wire into the drilling hole.

One problem with this type of measurement technique is that the sensor source and the sensor detector are both inside the borehole, which results in sending the measurement signal out into the general subterranean earth formation measure where the signal will reflect and scatter. As a result only a small volume of the earth formation near the wellbore responds to the applied sensor source. Even then, signal artifacts due to the borehole rugosity may cause large errors in the measurements. Another problem with this technique is that it does not define or restrict the volume of the earth formation investigated by the sensor signal very well. And finally, the analysis of the measurements gathered by this technique requires many semi-empirical corrections (to the measurements) to account for the poorly defined geometry and other factors including mud filtrate invasion.

The present invention is an apparatus and method for measuring the downhole chemical and or physical properties of the core during the coring operation. The present invention accomplishes this by appropriately instrumenting the core barrel with a downhole measurement device that allows the in-situ and real time measurement of the chemical and or physical properties of the core such as the porosity, bulk density, mineralogy, and also the fluid saturations of the core. The present invention offers many advantages over the prior techniques including the ability to measure the in-situ saturations of oil, water, and gas that are not currently possible with the current techniques. Additionally, the present invention offers an advantage over wireline downhole well logging because the sensor signal travels through the core within the inner core barrel, which is a known geometry (the inner core bore) unlike the earth formation along the well hole, that causes the sensor signal to scatter or reflect. Another advantage of the present invention is that it completes most if not all of the measurement gathering of the core before the core reaches the surface, which minimizes the cost of analyzing the core after it is at the surface.

SUMMARY OF THE INVENTION

The present invention is a method and apparatus for real time in-situ measuring of the downhole chemical and or physical properties of a core of an earth formation during a coring operation. The present invention comprises a downhole measurement device that couples to an inner and or an outer coring barrel near the coring bits. A sensor array coupled to an inner core barrel gathers in real time the in-situ measurements of the chemical and or physical properties of the core as the core moves past the sensor array in the inner core barrel. As the core enters the inner core barrel, the present invention takes the measurements at a desired repetition rate. The sensor array further comprises a signal or source generator and a complementary detector. A controller coupled to the sensor array controls the gathering of the measurements. After gathering the measurements, the controller stores the measurements in a measurement storage unit coupled to the controller.

One embodiment of the present invention provides for decoupling the measurement storage unit from the downhole measurement device, where the measurement storage unit then couples to a computing device. Another embodiment provides for a data link or a remote telemetry capability between the down measurement device and the computing device. After the computing device retrieves the measurements from the measurement storage unit, the computing device then analyzes the chemical and or physical proprieties of the core. The present invention comprises several embodiments that may use electromagnetic, acoustic, fluid and differential pressure, temperature, gamma and x-ray, neutron radiation, nuclear magnetic resonance, and mudwater invasion measurements to measure the chemical and or physical properties of the core that may include porosity, bulk density, mineralogy, and fluid saturations.

DETAILED DESCRIPTION OF THE INVENTION

The present invention is a method and apparatus for real time in-situ measuring of the downhole chemical and or physical properties of a core of an earth formation during a coring operation. This disclosure describes numerous specific details that include specific materials, structures, chemicals, elements, and processes in order to provide a thorough understanding of the present invention. For example, this disclosure describes the present invention in terms of embodiments directed to taking electromagnetic, acoustic, fluid and differential pressure, temperature, gamma and x-ray, neutron radiation, nuclear magnetic resonance, and mudwater invasion measurements. However, the practice of the present invention includes other measurement techniques other than the previously described ones. Additionally, one skilled in the art will appreciate that one may practice the present invention without these specific details. And finally, this disclosure does not describe some well known measurement or analysis processes in detail in order not to obscure the present invention.

Figure 1A:
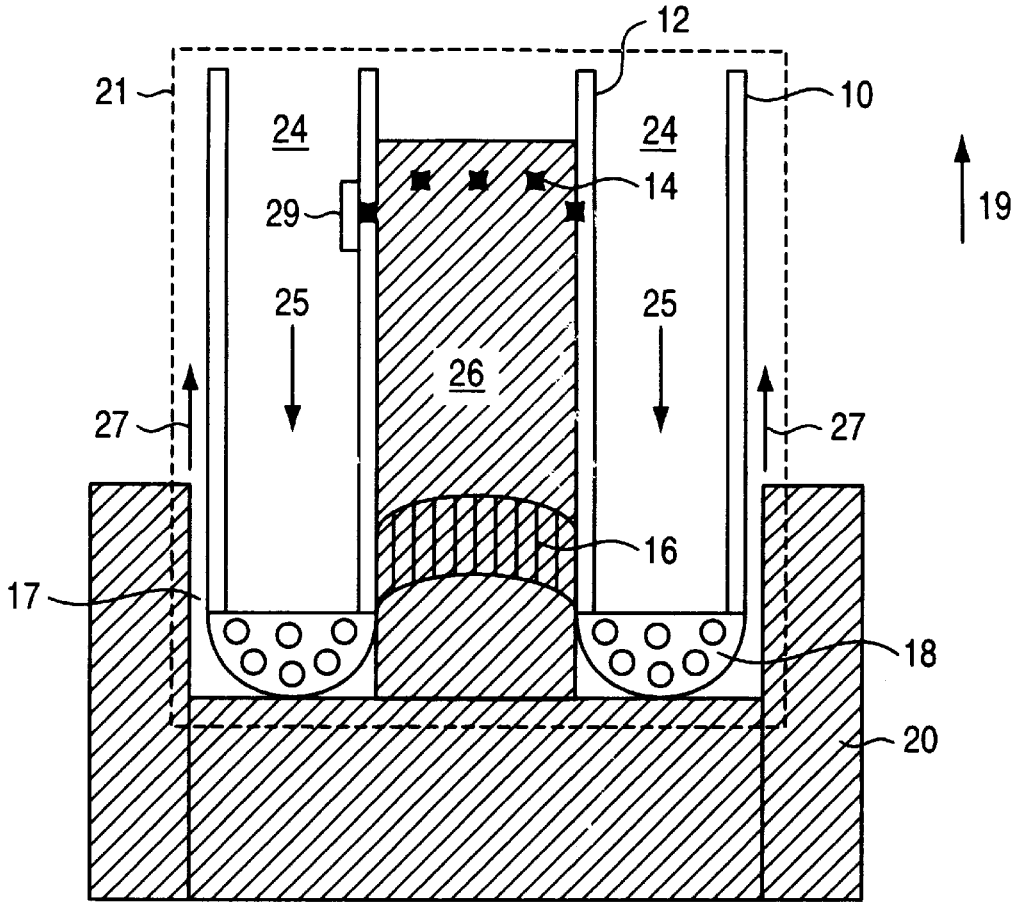
FIGS. 1A and 1B present a basic embodiment of the present invention.
Figure 1B:
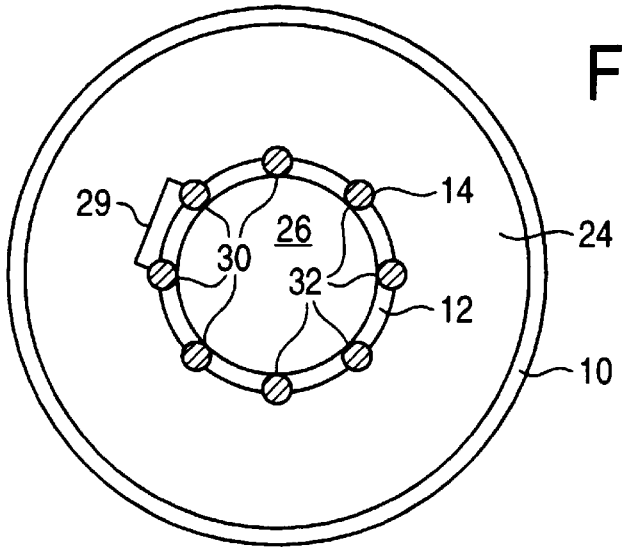

FIGS. 1A and 1B present a basic overview of the present invention. A coring device 21 cores into a subterranean earth formation 20. The coring device 21 is generally the downhole end of a series of coring barrels that extends from the wellbore up to the surface where the coring barrels couple to the drilling platform. The coring device 21 comprises an inner core barrel 12 and an outer core barrel 10. A coring bit 18 couples to a shoe 16, the inner coring barrel 12, and the outer coring barrel 10. As the coring bit 18 cores into the earth formation 20, a core 26 enters the inner core barrel 12. The downward drive of the coring apparatus 21 and the action of the coring bits 18 drives the core 26 upward towards the surface 19 within the inner core barrel 12.

To help control the temperature of the coring apparatus 21 and the coring process itself, the coring operator adds a mixture of earth and water ("mud") to the coring process. The circulation of the mud flow during the coring process starts at the surface where the coring operator pumps mud into the space or gap 24 between the inner core barrel 12 and the outer core barrel 10. As the mud flows down from the surface to the borehole area, the mud flow 25 is downward through the coring apparatus 21 to the coring bit 18. The mud passes through the coring bit 18 during the coring process, and then flows 27 back toward the surface between the gap or space 17 between the outer core barrel 10 and the walls of the well hole.

The core 26 comprises the part of the earth formation that the present invention will gather measurements from for the core's downhole chemical and or physical properties for later analysis. As the core 26 travels upward through the inner core barrel 12, it passes by a downhole measurement device 29, which the present invention uses to gather and store the measurements of the chemical and or physical properties of the core. The downhole measurement device 29 comprises electronic circuitry, as will be discussed below, and a sensor array 14. The sensor array 14 and the downhole measurement device 29 couple to the inner core barrel 12 to gather the measurements of the core 26 as it passes by the sensor array 14. The sensor array 14 further comprises, as will be discussed later, a signal source or generator 30 and a signal receiver or detector 32. The sensor array 14 may comprise several different types of sensors depending on the desired measurement. FIGS. 1A and 1B show the sensor array 14 as an evenly spaced circular array of signal generators 30 and signal receivers 32. One skilled in the art will recognize that the present invention may use other types of sensor array geometries that may include multiple levels of circular arrays and or an uneven but known spacing of sensors.

The present invention makes it possible to measure the downhole chemical and or physical properties of the core 26 during the coring process. The adaptability of the present invention is due to its ability to operate with a wide range of sensor types to gather the desired measurements for a particular type of analysis of one or more of the properties. For example, one embodiment of the present invention comprises a sensor array of electrodes that makes it possible to gather measurements about the electrical impedance of the core 26. Another embodiment of the present invention comprises a sensor array of acoustic sensors that makes it possible to gather measurements about the porosity of the core 26. Another embodiment of the present invention comprises temperature and or pressure sensors that provide additional information for use in conjunction with the above mentioned measurements. And finally, the sensor array 14 may comprise multiple types of sensors for simultaneously measuring a variety of properties, for example, gathering measurements using pressure, temperature, electrical, and or acoustic measurements.

Figure 2A:
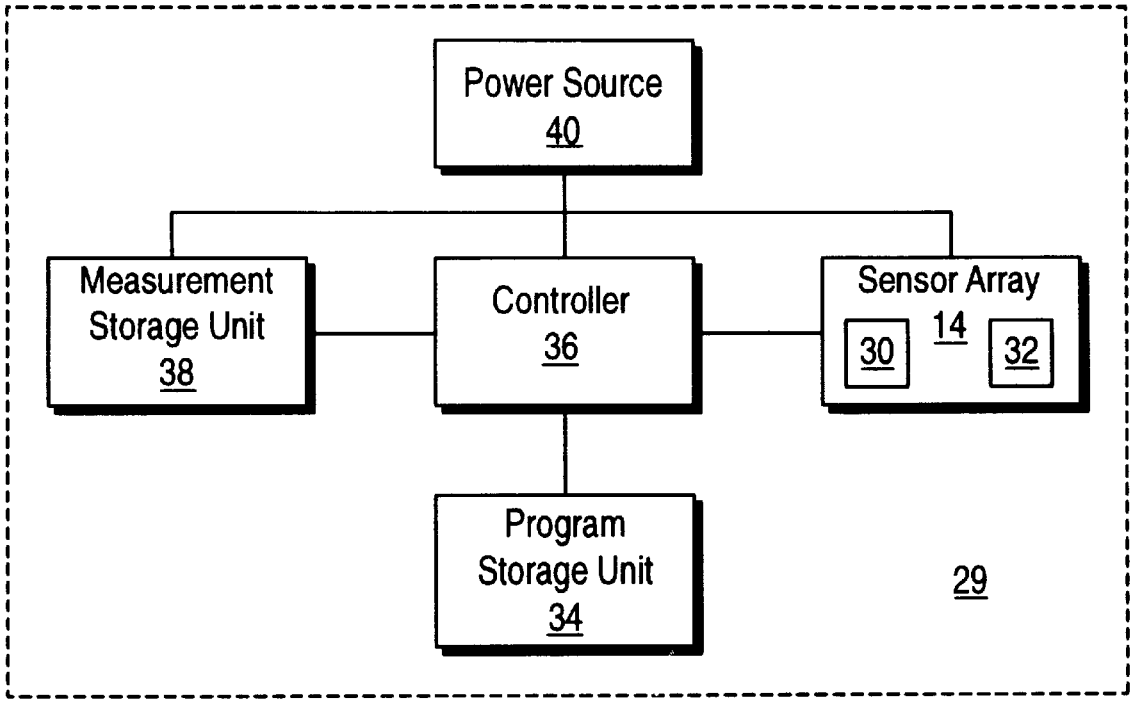
FIGS. 2A and 2B are block diagrams of an embodiment of the downhole measurement device of the present invention.
Figure 2B:
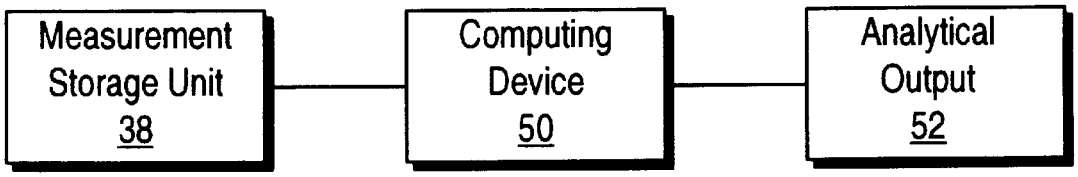

FIGS. 2A and 2B are block diagrams of one embodiment of the present invention. The present invention comprises a downhole measurement device 29 that couples to a coring device (21 of FIG. 1A). The downhole measurement device 29 is responsible for the gathering and storing of the measurements of the chemical and or physical properties. The downhole measurement device comprises a power source 40, a controller 36, a measurement storage unit 38, a program storage unit 34, and a sensor array 14.

The power source 40 supplies the operating power to the downhole measurement device 29. Coupled to the power source 40 is the controller 36, which controls the gathering of the measurements of the chemical and or physical properties by the sensor array 14. The controller 36 may comprise a microprocessor, microcontroller, DSP, or other similar type of processor. For example, the preferred embodiment of the present invention uses a DSP as the controller where the DSP may be a 16-bit Analog Devices ADSP-2101 for example. The controller 36 receives the measurements from the sensor array 14 and stores them for later retrieval in the measurement storage unit 38. The measurement storage unit 38 comprises electronic circuitry suitable for storing electronic data. For example, the measurement storage unit may comprise internal memory of the controller, external DRAM, SRAM, flash memory, or even memory on PC memory cards. The control program for the controller 36 resides in the program storage unit 34, which comprises electronic circuitry capable of program storage such as internal memory of the controller, external EPROM, ROM, or even flash memory for example.

The sensor array 14 further comprises a signal source or generator 30 and a signal receiver or detector 32. The responsibilities of the sensor array is to gather the measurements of the chemical and or the physical properties of the core. The sensor array 14 may comprise one or more sources 30 and one or more receivers 32. And in one embodiment of the present invention, the sensor array 14 couples to the outer surface of the inner core barrel 12. And in another embodiment of the present invention, the sensor array 14 couples to the outer circumference of the inner core barrel 12.

FIG. 2B is a block diagram that shows the analysis of the measurements of the chemical and or physical properties gathered and stored by the downhole measurement device 29. In this embodiment of the present invention, the downhole measurement device 29 gathers and stores the real time in-situ measurements of the core in the measurement storage unit 38. The coring operator will then bring the coring device (21 of FIG. 1A) to the surface for some reason (i.e., the trip to the surface is because of completing the coring sample). At the surface, the coring operator will remove the measurement storage unit 38 from the downhole measurement device 29 and couple the measurement storage unit 38 to a computing device 50. The computing device 50 may comprise for example a computer workstation or a personal computer. The computing device 50 will retrieve the measurements from the measurement storage unit 38 for analysis to produce an analytical output 52. The specific type of analysis for the measurements and the resulting analytical output 52 will depend on the type of measurements or information gathered. For example, if we gathered measurements about the impedance of the core, then we could produce a tomogram of the core's electrical impedance.

Figure 3A:
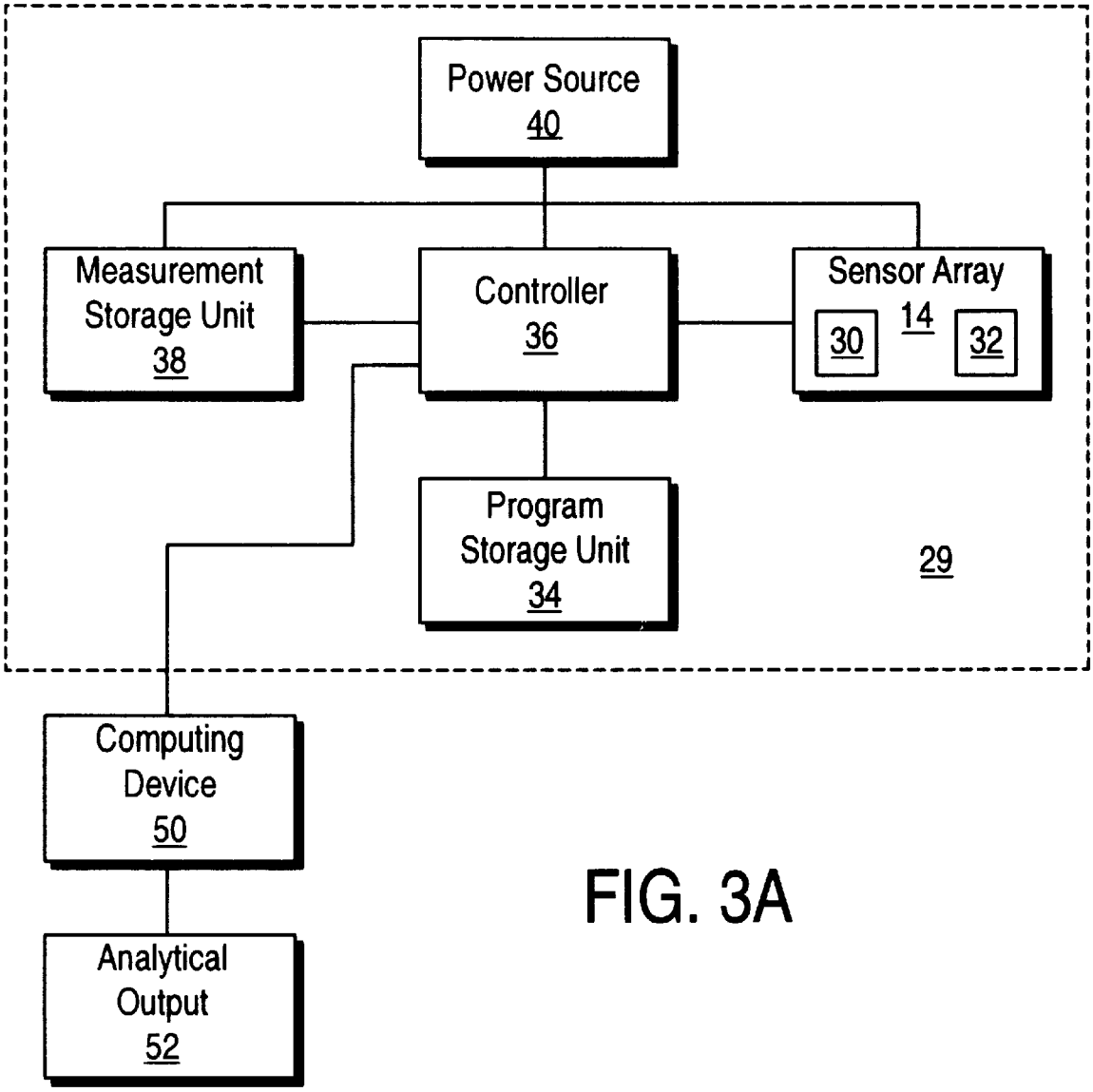
FIGS. 3A and 3B are block diagrams that illustrates another embodiment of the downhole measurement device of the present invention with real time analysis of the measurements.
Figure 3B:
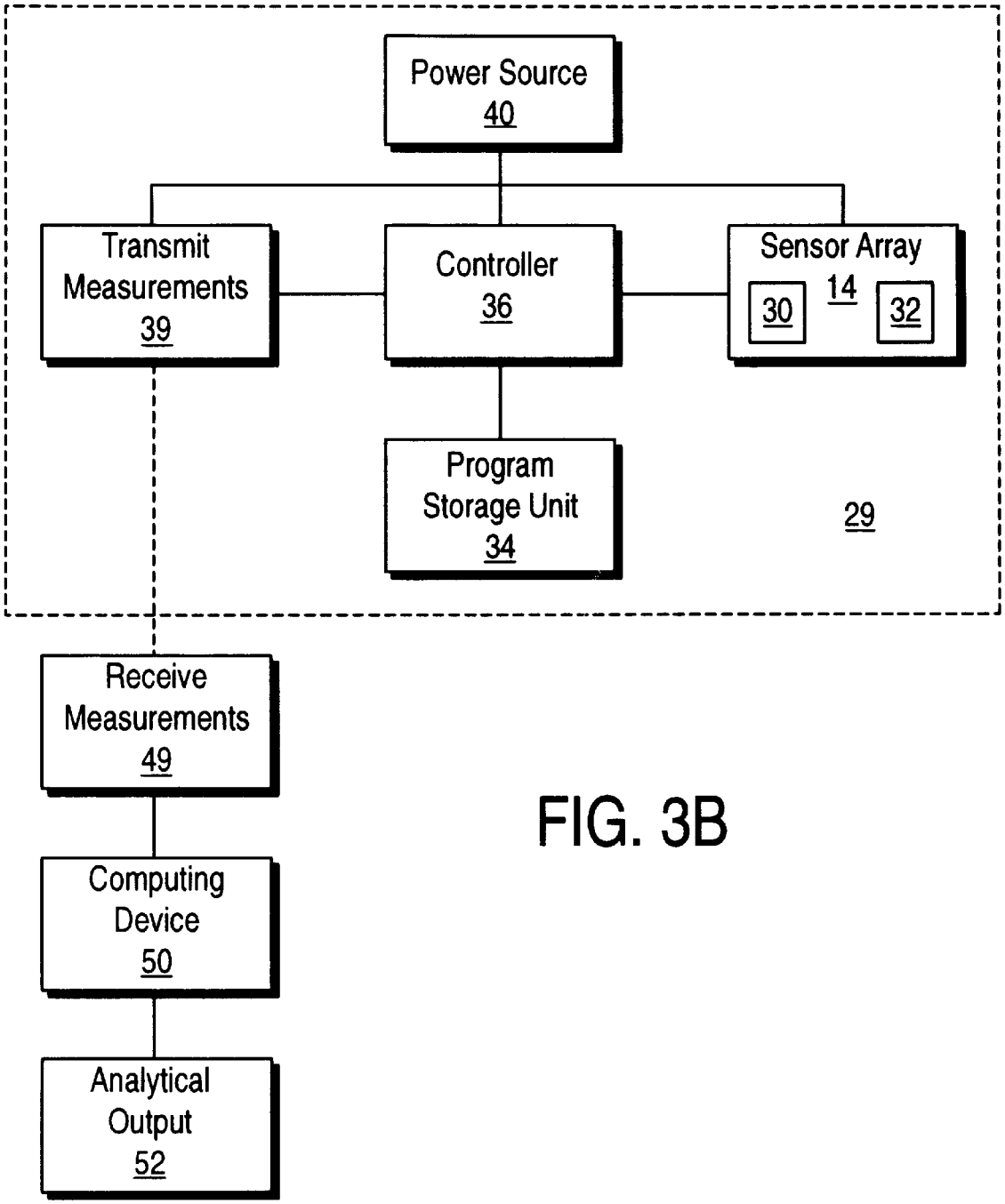

FIGS. 3A and 3B are block diagrams that illustrate another embodiment of the present invention that includes the real time analysis of the chemical and or physical properties of the core from the gathered measurements. This embodiment is similar to the embodiment described in FIGS. 2A and 2B except that the computing device 50 couples to the downhole measurement device 29 either directly or through remote telemetry instead of indirectly via moving the measurement storage unit 38 from the downhole device to the computing device. FIG. 3A illustrates an embodiment of the present invention with a data communications link connecting the downhole measurement device 29, while it is in the wellbore, to the computing device up at the surface. The data communications link may comprise any type of medium for transmitting digital information, for example a serial cable or a fiber optic cable. This embodiment additionally illustrates an optional measurement storage unit 38 for storing and or buffering the measurements before transmittal to the computing device. With real time analysis of the measurements, it is possible to use the computing device 50 as the measurement storage unit.

FIG. 3B illustrates an embodiment of the present invention with a remote telemetry capability. With remote telemetry, a physical connection between the downhole measurement device 29 and the surface computing device 50 is not necessary. A transmitter 39 transmits the measurements from the downhole measurement device 29 to a receiver 49 that couples to a computing device 50. The transmitter 39 and receiver 49 could comprise electronic circuitry for transmitting and receiving radio frequency signals. Alternatively, the transmitter and receiver could comprise circuitry and hydraulics for transmitting and receiving fluid pulses or signals where the transmission of the pulse is through the mud column that goes to the surface. And, this embodiment of the present invention may comprise a measurement storage unit is optional with the downhole measurement device 29 for storing and or buffering the measurements.

Figure 4:
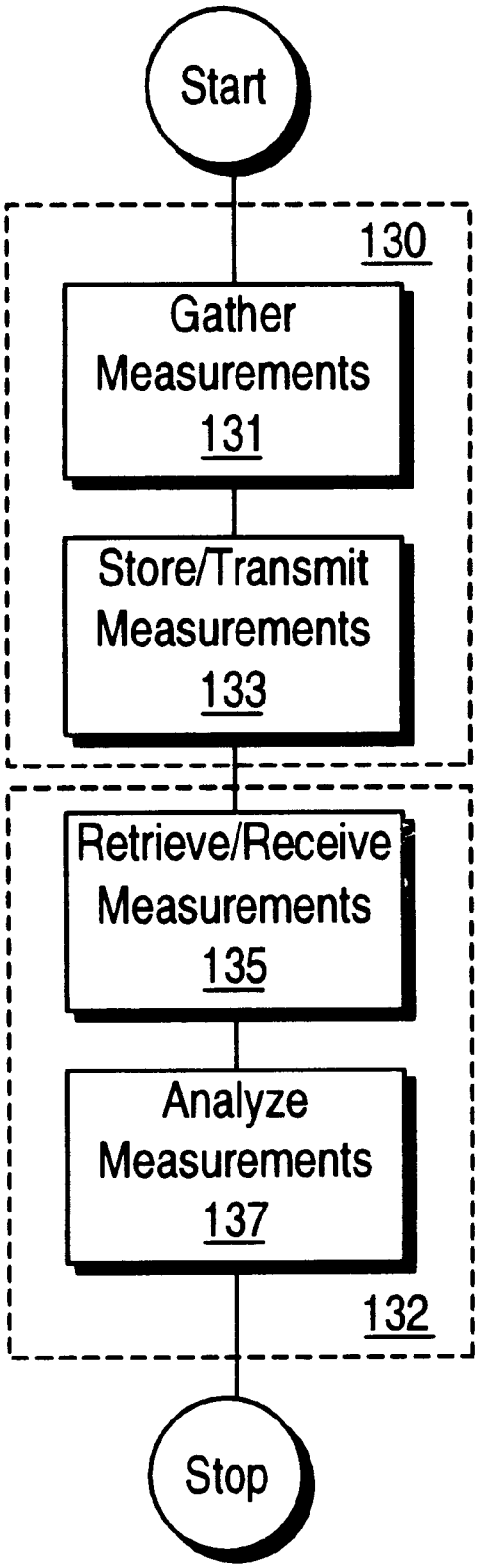
FIG. 4 is a block diagram of the software component of the present invention.

FIG. 4 is a block diagram of the software component of the present invention. The present invention comprises one or more programs that provide the present invention with the ability for real time in-situ measuring of the chemical and or physical properties of a core while coring. The software component of the present invention further comprises a downhole software component 130 that operates in the downhole measurement device for gathering and storing the measurements and a surface software component 132 that operates in the computing device that retrieves and analyzes the measurements to produce the analytical output. The downhole software component 130 is responsible for the gathering of the measurements 131 through the sensor array and storing and or transmitting the measurements 133. The surface software component 132 is responsible for retrieving and or receiving the measurements and analyzing the measurements 137 to produce a desired analytical output.

Figure 5A:
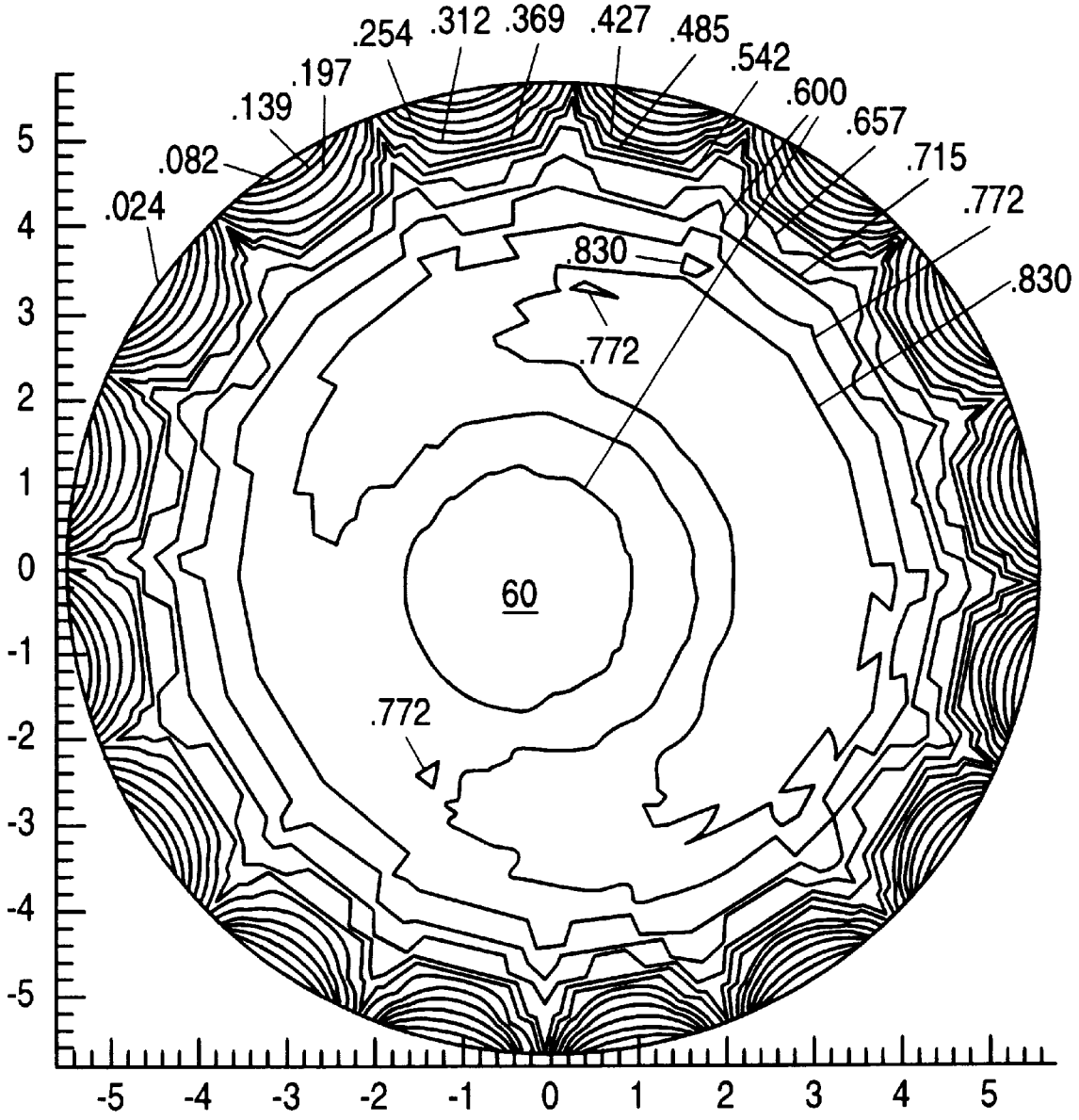
FIGS. 5A and 5B illustrate an example tomographic analysis of coring measurements possible with the present invention.
Figure 5B:
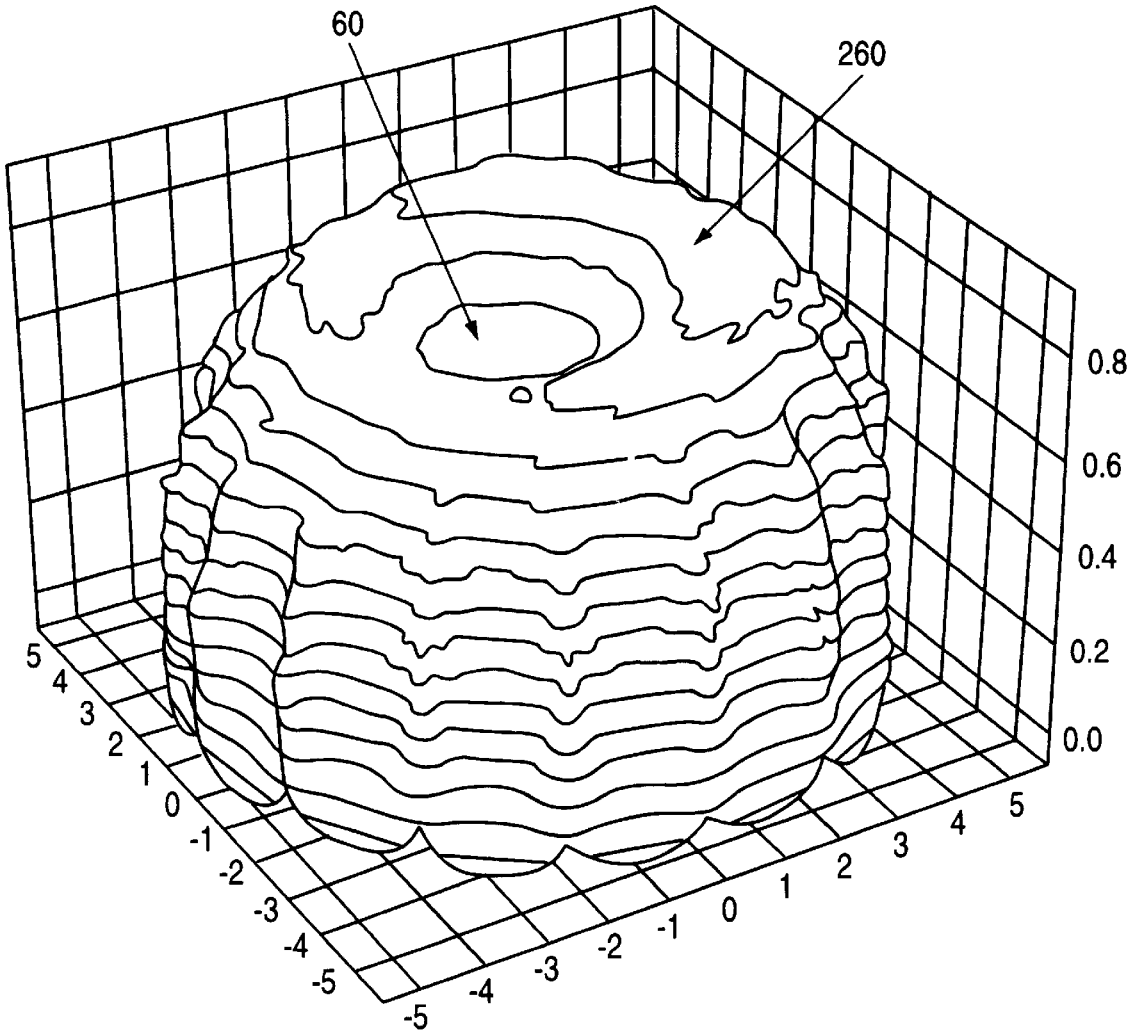

FIGS. 5A and 5B illustrate one type of analysis possible by the present invention using the measurements of the chemical and or physical properties. These figures illustrate measurements gathered by a prototype of the downhole measurement device of the present invention. In the lab, we placed a radial section of a core sample 260, with a hole 60 in the middle of the core sample, into the prototype and gathered the impedance measurements using a sensor array comprising sixteen evenly spaced electrodes in a circular array. These figures illustrate an impedance image using tomography of the core sample generated by the imbition of salt water into the core. The hole 60 is visible as an area of low impedance within the core.

The present invention analyzes the measurements to produce an analytical output. The particular analysis of the core depends upon the type of information sought from the core sample. Using the examples of FIGS. 5A and 5B, the present invention analyzed the measurements of the core sample 260 by using a computational inverse program on the measurements, for example a back-projection algorithm, that converted the measurements into a two-dimensional impedance image and a three-dimensional impedance image. Alternative analysis methods for the inversion of the measurements could include, for example, direct inversion via Green functions, conjugate-gradient or Newton-Raphson methods applied to finite-element models of a forward electromagnetic problem, neural networks, genetic algorithms, or simulated annealing algorithms.

Figure 6A:
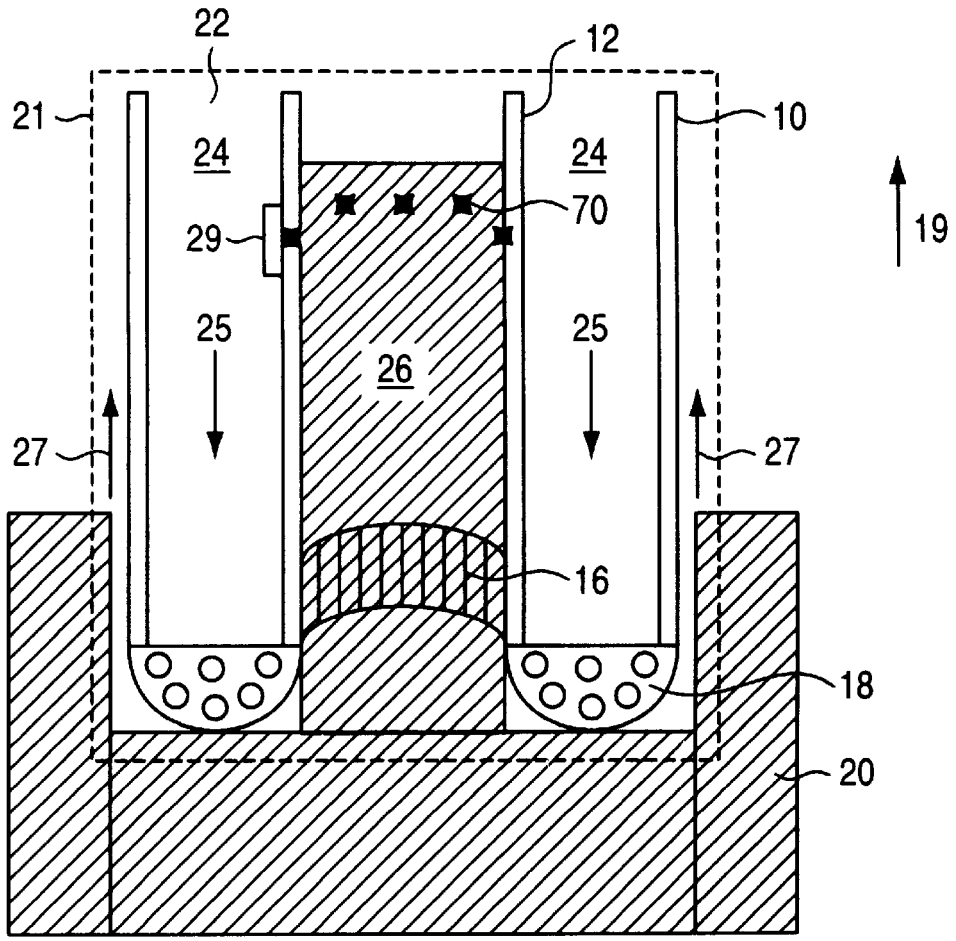
FIGS. 6A and 6B disclose an embodiment of the present invention using electromagnetic signals to gather measurements about a core.
Figure 6B:
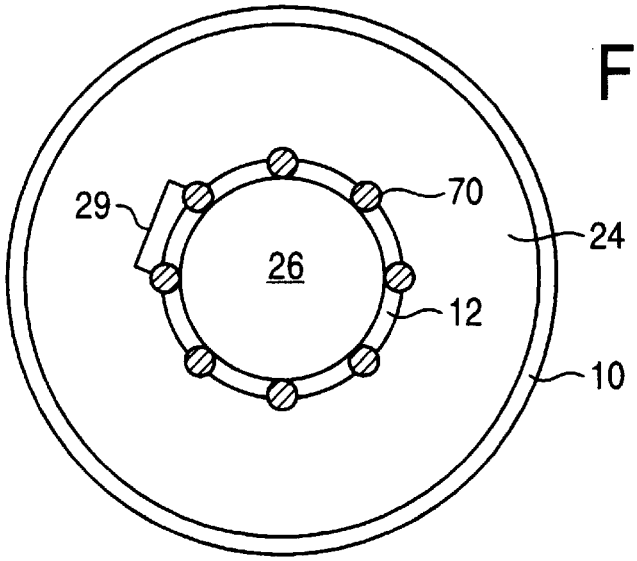

FIGS. 6A and 6B discloses an embodiment of the present invention using electromagnetic signals to gather information about a core. This embodiment of the present invention uses a sensor array that comprises an array of electrode sensors 70. The electrode sensor array may couple to the inner core barrel 12 by flush mounting either to a nonconductive section of the inner core barrel or onto insulating patches on a conductive inner core barrel. Additionally, the present invention may use alternative types of electrodes that may include ring electrodes, induction coils, or plate electrodes, where any of the electrodes may use conducting materials that comprise metals, carbon and conductive polymers, and or ceramics.

The downhole measurement device 29 uses the sensor array of electrodes 70 to generate and measure direct or alternating currents and voltages. For example, the downhole measurement device 29 may gather and store electrical measurements with the electrode sensor array 70 using the adjacent four-electrode protocol. This protocol uses an adjacent pair of electrodes where a fixed AC current composed of one or more frequencies is emitted and received between an adjacent pair of electrodes and the potential differences between all other adjacent electrode pairs are measured. The measurements may be repeated for other adjacent pairs of electrodes acting as the sources and sinks for the current. The multiple frequencies used by the present invention may comprise frequencies from approximately 1 KHz to 300 KHz, although other frequency ranges are possible as well. The analysis of the low frequency signals is electrical resistivity tomography, and the analysis of the high frequency signals is electrical capacitance tomography.

The present invention may also use other electrical measurement protocols that may include, for example, an opposite four-electrode method where current is injected between opposite electrodes and potential differences measured between adjacent electrode pairs; two-electrode methods with a current emitter and receiver and simultaneous measurement of potential differences; and or adaptive methods with multiple current emitters and receivers and simultaneous measurement of potential differences between all electrode pairs.

We can determine the distribution of the impedance in the core using the gathered electrical measurements by solving the inverse problem to Maxwell's equations using an inversion algorithm such as a back-projection algorithm that converts the potential measurements into a two-dimensional or three-dimensional image of the impedance field as a function of depth. To analyze the fluid saturations, we can convert the distribution of the electrical impedance in the core into an image of the fluid saturations based on the electrical properties of the fluids in the core. For example, we can covert the impedance field using two or more frequencies into a hydrocarbon (oil/gas)-water saturation field by knowing the impedance properties of hydrocarbons and water.

Figure 7A:
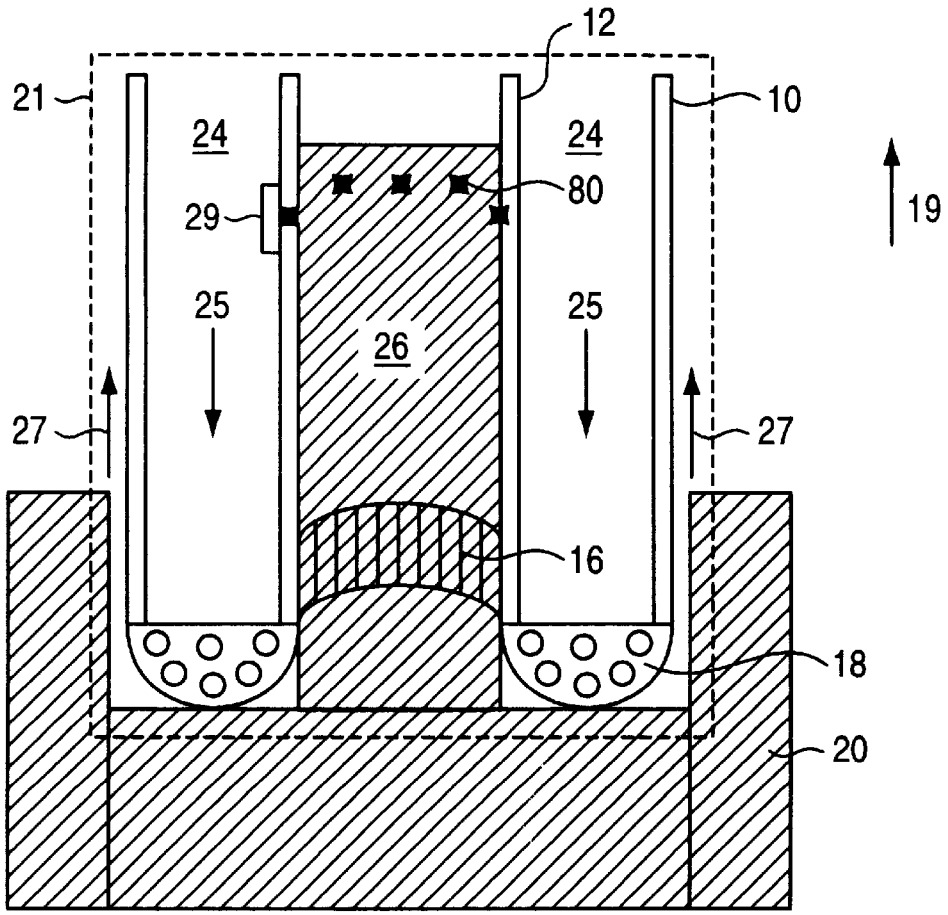
FIG. 7A and 7B disclose an embodiment of the present invention using acoustic signals to gather measurements about a core.
Figure 7B:
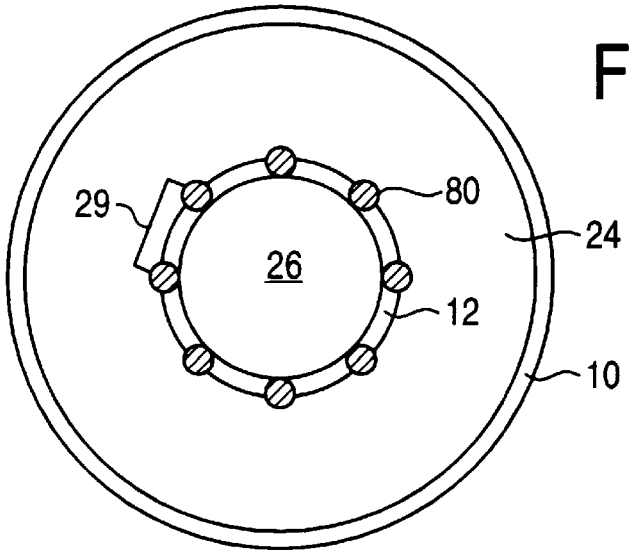

FIG. 7A and 7B disclose another embodiment of the present invention using acoustic signals to gather information about a core. This embodiment of the present invention uses a sensor array that may comprise a piezoelectric and or a magnetostrictive source and detector 80. The acoustic sensor array 80 may couple with the inner core barrel 12 to be flush with the core 26 or acoustically coupled to the core through the fluid in the core barrel.

The present invention uses the acoustic sensor array 80 to gather acoustic measurements (either transmitted or reflected) of the core 26. We can use the transmitted or reflected signals to measure the velocities and attenuations of the p, s, and Rayleigh waves. With these measurements, we can determine the petrophysical properties of the core, for example, we can determine the porosity of the core using the Wylie time average equation and the elastic moduli of the core using well known equations in elasticity. Additionally, we can determine the porosity of the core 26 by measuring the travel time (velocity) of p and s waves between pairs of the acoustic sensor array 80 and using the Wylie time average equation. Or, we can use a simulated annealing inversion algorithm to construct an acoustic impedance map of the core using measurements from multiple source—receiver measurements.

Figure 8A:
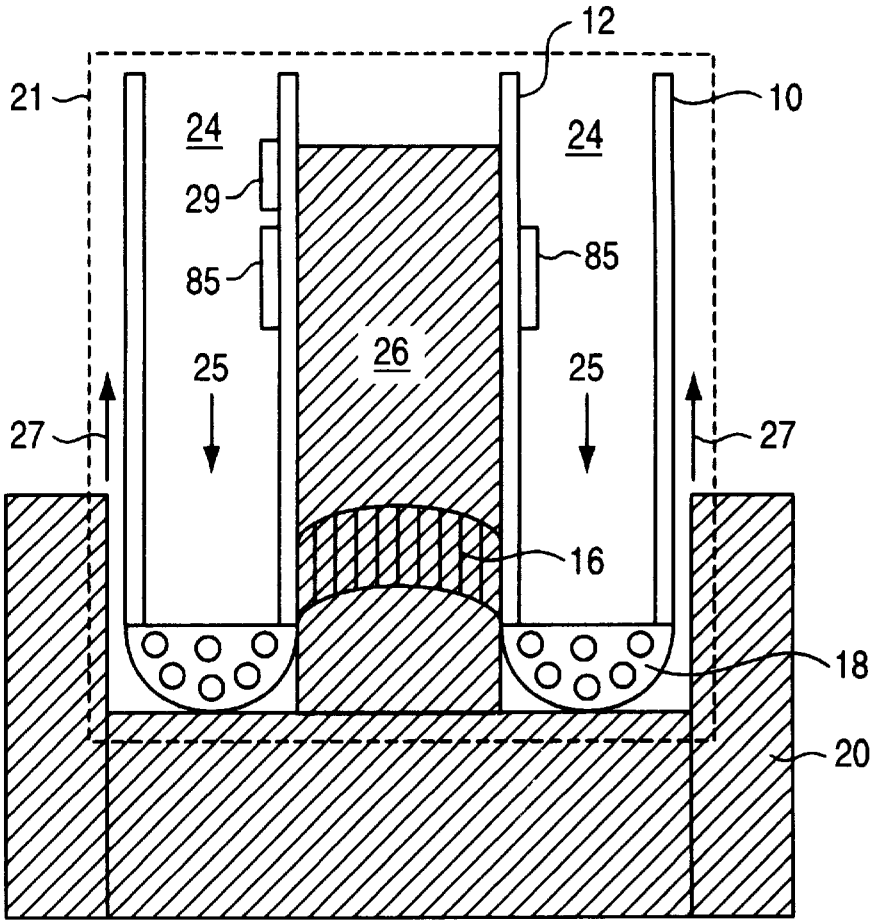
FIG. 8A and 8B discloses an embodiment of the present invention using nuclear magnetic resonancing to gather measurements about a core.
Figure 8B:
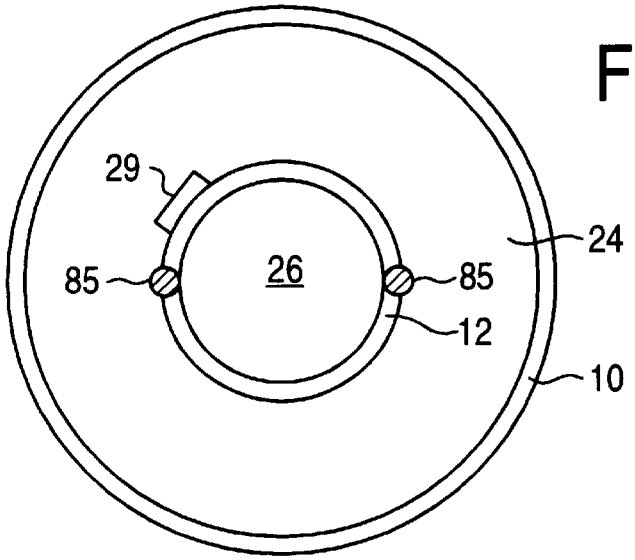

FIG. 8A and 8B discloses another embodiment of the present invention using nuclear magnetic resonance (MRI) to gather information about a core. This embodiment of the present invention uses a sensor array that comprises a magnetic field generator, a radio frequency (RF) source, and a RF detector 85. Making downhole permeability measurements typically involves the injection of a volume of fluid into the core at a known rate while recording the pressure as a function of time. With the use of MRI, however, we can measure the permeability of the core directly. For example, when we use appropriate RF pulse sequences, we are then able to measure the relaxation times $T_1$ or $T_2$ of the protons in the water. The protons adjacent to the rock-water interface have different relaxation times than protons in bulk water. The measurement of relaxation times, therefore, provides us with a measure of the specific surface area of the rock. This measurement together with the porosity of the rock can be used to compute the permeability of the core through the Kozeny equation. The proton density in the core also provides a measure of the bound (adjacent to solid surfaces) water and bulk or free water.

Figure 9:
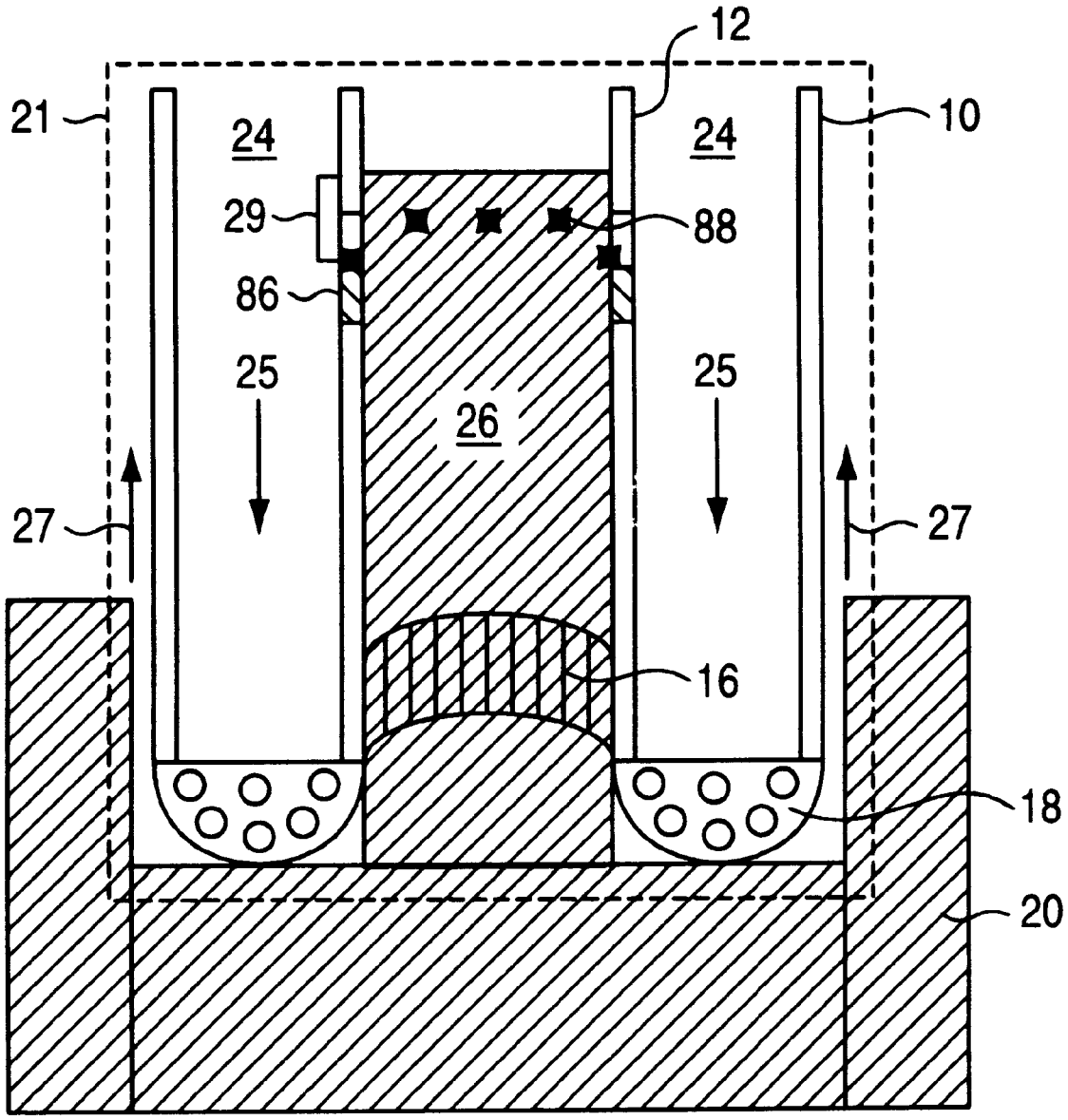
FIG. 9 discloses an embodiment of the present invention for gathering permeability measurements about a core.

FIG. 9 discloses an embodiment of the present invention for gathering downhole permeability information about a core using pressure measurements. Making downhole permeability measurements typically involves the injection of a volume of fluid into the core at a known rate while recording the pressure as a function of time. Alternatively, the injection of the fluid is at a constant pressure while recording the rate of injection as a function of time. We use these principles when making permeability measurements in the lab using minipermeameters. In all of these measurements, we infer the permeability from the transient pressure or flow rate response.

Referring to FIG. 9, this embodiment of the present invention uses a sensor array that comprises one or more flow injection devices, for example, an electrically activated syringe 86 with a probe tip that seals against the face of the core 26 and allows the injection of fluid into the core 26. The syringe 86 containing the injection fluid couples either in or above the inner core barrel. The probe tip of the syringe mounts on the inside wall of the inner core barrel 12 and activates to press against the core before injecting the fluid. The syringe couples to the probe tip by a hydraulic fluid line.

We can then measure the fluid pressure and the differential pressure in the core by a pressure transducer 88. And, we can determine the permeability of the core by fitting the pressure response measurements to the expected pressure response obtained from a solution of a flow problem for flow into a finite cylinder.

The present invention is adaptable to a variety of pressure sensors that may comprise mechanical gauges, metal strain gauges, capacitance gauges, sapphire gauges, quartz gauges, compensated quartz gauges, and piezoelectric gauges. Additionally, the present invention may use a variety of geometries for the sensor array when using a fluid injection/withdrawal sensor where the geometries may comprise a single source (fluid injection device) or sink (fluid withdrawal device) of fluid, one source and one sink placed a known distance away from each other, and multiple sources and sinks placed at specified distances from each other. And, the present invention can make other measurements of the core that include constant pressure fluid injection and or withdrawal and constant rate fluid injection and or withdrawal.

An alternative embodiment of the present invention can make downhole temperature measurements while coring that uses a sensor array that comprises temperature probes such as bimetallic thermocouples. We can couple these types of temperature probes in, around, or in the vicinity of the inner core barrel 12. Using temperature probes allows us to gather and record the temperature measurements both during coring and while bringing the core to the surface.

Figure 10:
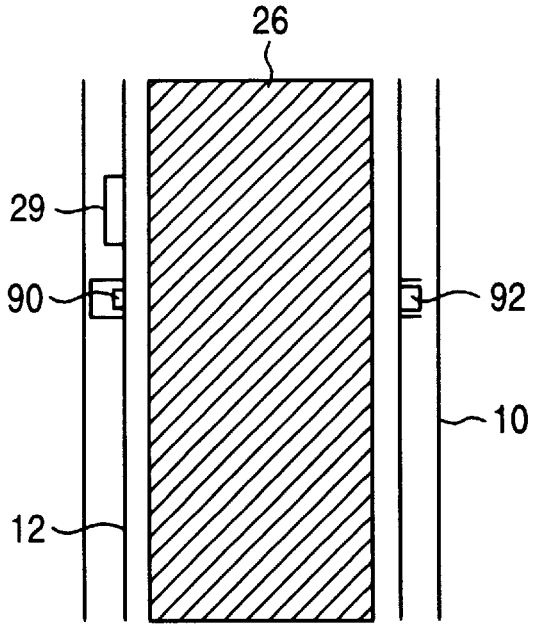
FIG. 10 discloses an embodiment of the present invention using gamma rays to gather measurements about a core.

FIG. 10 discloses an embodiment of the present invention using gamma rays to gather information about a core. We can use transmission measurements of gamma and X-radiation through a core to help us determine the composition, lithology, and fluid saturations in the core. The attenuation of γ and X-radiation while passing through matter is a function of the energy of the radiation and of the atomic number and density of the intervening matter. For the range of atomic numbers in a typical earth formation of materials and for low to intermediate energies below 350 keV, the attenuation is a strong function of the atomic number. For energies ranging from intermediate up to a few MeV, the attenuation is a strong function of the material density. Computer aided tomography (CAT) uses intermediate gamma and X-radiation radiation transmitted from an external source to an array of detectors, arranged around the core from the source, to obtain a two or three dimensional image of the individual materials comprising the core as a function of their densities. Alternatively, the transmission of a mixture of gamma ray energies in the low energy range, a function of both the atomic number and the density, can provide a different distribution of phase compositions in the core.

The embodiment of the present invention in FIG. 10 uses a sensor array of one or more well collimated gamma ray sources 90 emitting several different gamma rays of low to intermediate energies and an opposing radiation detector 92. The source 90 and detector 92 couple to the inner core barrel 12 The gamma intensity loss (I/lo) for the transit of each energy through the core 26 is a function of the mass attenuation coefficient ($\mu$) for that energy (i) at the density (ρ) and fraction of each phase (Sj) given a core of diameter D. The values of ρ and $\mu$ij for each phase are tabulated in the literature and can be measured experimentally. Therefore, the composition of each designated phase can be obtained from the solution of S-1 energy equations plus the saturation condition; $\Sigma S_j=1$.

$$\frac{I}{I_0} = \exp - \left(\sum \rho S_j \mu_{ij}\right) D \tag{1}$$

We can use this method to measure gas, oil, and water saturation in cores using two different gamma energies. We can combine any sources of suitable half-life and gamma energy together for this method including for example the 60 keV gamma from 248 year half-life Am-241, the 125 keV gamma from the 270 day Co-57, or the 80 keV and 350 keV from the 7.2 year half life Ba-133). Depending on the requirements of sensitivity, energy discrimination, and operating conditions, the present invention may use any number of commercially available gamma detectors such as scintillation detectors, semiconductor diode detectors, gas filled detectors, and others.

An alternative embodiment is to measure the response from each different gamma ray by means of an energy-sensitive detector. This emphasizes differences in atomic number due to the photoelectric absorption coefficient, t, where Z is the atomic number of the core materials and E is the incident gamma ray energy:

$$t \approx \left[\frac{Z^5}{E^{3.5}}\right] \tag{2}$$

As above, this results in j equations which can be solved for the fractional contribution from each component.

An alternative embodiment of the present invention could use transmission, through the core, of a single source of radiation to monitor the composition of the core by computer aided tomography (CAT). The radiation may be either from a radioactive source or from an x-ray generator. With this embodiment, a sensor array comprising a planar array of radiation detectors, arranged around the core, opposite from the source, measures the transmitted radiation. To increase the coverage of the measurements, we could rotably couple the sensor array to the inner core barrel 12. And, we can use a variety of computer algorithms to convert the measurements (here, the counting data) to a planar image of the density distribution in the core that allows us to discern the material composition of the core.

Another embodiment of the present invention could use neutron radiation to gather information about the core. The elastic scattering by hydrogen atoms dominates the transmission of neutron radiation through the core where the energy loss is directly proportional to the hydrogenous material in the core that continues until the neutrons are at thermal energy. For most oil field situations, hydrogen is associated with water and or hydrocarbon fluid and represents the fluid filled pore volume of the core. This volume, measured by any of the methods discussed in this disclosure, represents the total pore volume. Thermalized neutrons can react with surrounding nuclei to form an activated state which deactivates to ground state by emission of prompt, or occasionally delayed, gamma radiation. The energy of the emitted gamma radiation is characteristic of the nuclide involved and its intensity is proportional to the amount of that nuclide present. Therefore, it is a means for chemical analysis of some of the core components. The gamma radiation is emitted isotropically and can be monitored by any energy sensitive gamma detector.

The neutron radiation embodiment of the present invention would use a sensor array with a neutron source that may comprise a fission source as Cf-252, chemical beryllium sources such as those containing Am-241, Po-210, Ra-226, etc. as alpha emitters for the Be(a,n)C reaction, or particle accelerators using the D-D or D-T reaction, etc. The slow neutron flux may be measured by a neutron detector or counter such as a He-3 or $BF_3$ proportional counter or a LiI scintillation counter, mounted across the core 26 from the source as part of the sensor array. The energy lost during neutron transmission is an exponential function of the hydrogen concentration.

An alternative embodiment of the present invention may measure prompt or delayed gamma emission following slow neutron reactions with surrounding nuclei. The energy of the emitted gamma radiation is characteristic of the interacting nucleus, so that its energy (and time) spectrum provides a signature of the chemical composition of the core 26. The gamma radiation is measured by an energy sensitive detector either unaffected by, or suitably shielded and positioned from, neutron interactions as part of the sensor array. A typical usage embodies a gas proportional counter or ion chamber, or a scintillation detector or diode detector well shielded from neutron interactions.

Figure 11:
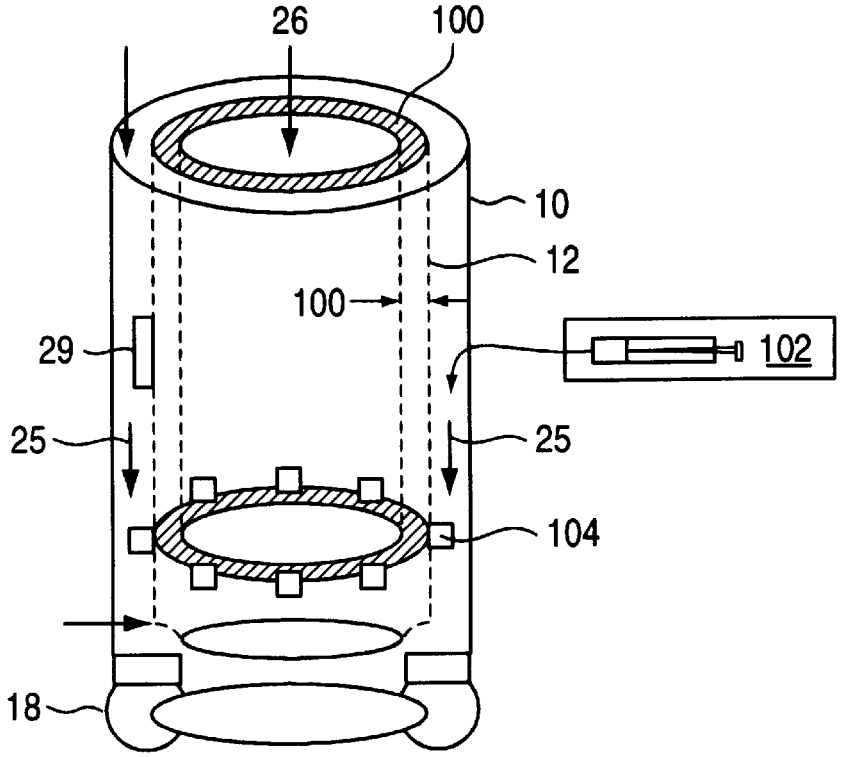
FIG. 11 discloses an embodiment of the present invention using a tracer injection and measurement system for gathering measurements about a core.

FIG. 11 discloses an embodiment of the present invention that uses a tracer injection and measurement system for gathering information about a core. Mudwater invasion of the core is a consequence of the drilling process, and it is a poorly understood phenomenon that impacts all measured saturations and should be monitored where it occurs (i.e., downhole, not at the surface). This embodiment of the present invention measure s mudwater invasion of the core 26 by using a sensor array that comprises a circumferential array of gamma detectors 104, coupled to the inner core barrel 12, in a plane around the core 26. We can measure mudwater invasion of the core 26 by injecting a gamma-emitting water tracer into the mud flow 25 above the coring bit 18 using a tracer injector 102. The gamma-emitting water tracer will "invade" the core 26 as part of the coring process, and will allow us to measure the progress of the invasion with the gamma detectors. With these measurements, we can use a computer aided tomographic technique to determine the location and distribution of invaded water in the xy plane of the core.

An alternative embodiment of the present invention is to use a positron emitting tracer instead of the above gamma-emitting water tracer. Positron emission tomography has the particular advantage of reducing mud tracer interference when using a positron-emitting mudwater tracer. There are several precautions to take in order to avoid interference between radiation from the tracer in the core and that in the mud as well as with gamma transmission measurements higher up on the core and radioactive contamination at the surface. These precautions could be, for example, using short half-life tracers derived from isotope generators such as the 2.7 minute half-life Ba-137m, and pulse injection of the tracer to minimize the time that the tracer in the mud and in the core barrel are in conjunction.

One embodiment of the present invention using positron emitting tracer measurements for downhole mudwater monitoring is to use as part of the sensor array, for example, a 70 minute half-life gallium-68 from the 68Ge/68Ga isotope generator to further reduce mud interference and to allow positron emission tomography (PET). Positrons undergo annihilation when they collide with an electron, emitting two 0.51 MeV coincident gamma rays, 180° apart. We would then measure the emitted radiation by a sensor array comprising gamma detectors and minimize the background interference by using coincidence between the detector pairs of the sensor array. A suitable choice of the coincident detector pairs would allow us to determine the spatial distribution of the invading mud water within the core.

Alternatively, we could use inject into the mud flow a non-radioactive tracer having a high cross-section for gamma or x-ray absorption. This would allow us to monitor the mud water tracer invasion with a sensor array comprising a gamma source and a planar array of detectors surrounding the core. A suitable, water soluble, non-adsorptive water tracer of high atomic number such as tungstate ion is easy to identify in a normal core using a conventional gamma ray source such as Cs-137.

The present invention is an apparatus and method for measuring the downhole chemical and or physical properties of the core during the coring operation. The present invention accomplishes this by appropriately instrumenting the core barrel to allow in-situ and real time measurement of the chemical and or physical properties of the core such as the porosity, bulk density, mineralogy, and fluid saturations of the core. The present invention offers many advantages over prior techniques including the ability to measure the in-situ saturations of oil, water, and gas that are not currently possible with the current techniques. Additionally, the present invention offers an advantage over wireline downhole well logging because the sensor signal travels through core within the inner core barrel, which is a known geometry (the inner core bore) unlike the earth formation along the well hole, that causes the sensor signal to scatter or reflect. Another advantage of the present invention is that it completes most if not all of the measurement gathering of the core before the core reaches the surface, which tends to minimize the cost of analyzing the core after it is at the surface.

We claim:

1. An apparatus that integrates with an inner core barrel near the core bit where the apparatus measures in-situ chemical and or physical properties of a core from an earth formation, comprising:

a sensor array that gathers the in-situ measurements of the chemical and or physical properties of the core from the earth formation, said sensor array integrates with an inner core barrel near the coring bit, said sensor array comprises a signal source or generator and a signal receiver or detector, said sensor array gathers the measurements as the core moves past said sensor array; and a controller coupled to said sensor array that controls the gathering of the measurements.

2. The apparatus of claim 1 further comprising a measurement storage unit coupled to said controller that stores the measurements.

3. The apparatus of claim 1 wherein said sensor array further comprises an electrical impedance sensor array.

4. The apparatus of claim 1 further comprising a computing device that analyzes the measurements.

5. The apparatus of claim 1 wherein said sensor array further comprises an electromagnetic sensor array.

6. The apparatus of claim 1 wherein said sensor array further comprises a gamma ray sensor array.

7. The apparatus of claim 1 wherein said sensor array further comprises an acoustic sensor array.

8. An apparatus that integrates with an inner core barrel near the core bit where the apparatus measures the in-situ chemical and or physical properties of a core from an earth formation, comprising:

sensing means for gathering the in-situ measurements of the chemical and or physical properties of the core from the earth formation, said sensing means integrates with an inner core barrel near the coring bit, said sensing means comprises a signal source or generator and a signal receiver or detector, said sensing means gathers the measurements as the core moves past said sensing means; and a controller coupled to said sensing means that controls the gathering of the measurements.

9. The apparatus of claim 8 further comprising means for analyzing the measurements.

10. The apparatus of claim 8 further comprising means for storing the measurements.

11. The apparatus of claim 8 wherein said sensing means further comprises means for gathering electrical impedance measurements.

12. The apparatus of claim 8 wherein said sensor means further comprises an electromagnetic sensor array.

13. The apparatus of claim 8 wherein said sensor means further comprises a gamma ray sensor array.

14. The apparatus of claim 8 wherein said sensor means further comprises an acoustic sensor array.

15. A method of measuring the in-situ chemical and or physical properties of a core from an earth formation with an apparatus that integrates with an inner core barrel near the core bit, comprising:

gathering the in-situ measurements of the chemical and or physical properties of the core from the earth formation with a sensor array that integrates with an inner core barrel near the coring bit, said sensor array comprises a signal source or generator and a signal receiver or detector, said sensor array gathers the measurements as the core moves past said sensor array; and controlling the gathering of the in-situ measurements of the chemical and or physical properties of the core.

16. The method of claim 15 further comprising the step of analyzing the measurements.

17. The method of claim 15 further comprising the step of storing the measurements.

18. The method of claim 15 wherein said step of gathering further comprises gathering electrical impedance measurements.

19. The method of claim 15 wherein said sensor array further comprises an electromagnetic sensor array.

20. The method of claim 15 wherein said sensor array further comprises a gamma ray sensor array.

21. The method of claim 15 wherein said sensor array further comprises an acoustic sensor array.

22. A program storage device readable by a computer, tangibly embodying a program of instructions executable by the computer to perform method steps for a method of measuring the in-situ chemical and or physical properties of a core from an earth formation with an apparatus that integrates with an inner core barrel near the core bit, comprising:

gathering the in-situ measurements of the chemical and or physical properties of the core from the earth formation with a sensor array that integrates with an inner core barrel near the coring bit, said sensor array comprises a signal source or generator and a signal receiver or detector, said sensor array gathers the measurements as the core moves past said sensor array; and controlling the gathering of the in-situ measurements of the chemical and or physical properties of the core.

23. The program storage device of claim 22 further comprising the step of storing the measurements.

24. The program storage device of claim 22 wherein said step of gathering further comprises gathering electrical impedance measurements.

25. The program storage device of claim 22 further comprising the step of analyzing the measurements.

26. The program storage device of claim 22 wherein said sensor array further comprises an electromagnetic sensor array.

27. The program storage device of claim 22 wherein said sensor array further comprises a gamma ray sensor array.

28. The program storage device of claim 22 wherein said sensor array further comprises an acoustic sensor array.

29. A method of manufacturing an apparatus that measures the chemical and or physical properties of a core from an earth formation where the apparatus integrates with an inner core barrel near the core bit, comprising:

providing a sensor array that gathers the in-situ measurements of the chemical and or physical properties of the core from the earth formation near the coring bit, said sensor array gathers the measurements as the core moves past said sensor array, said sensor array comprises a signal source or generator and a signal receiver or detector, said sensor array integrates with an inner core barrel; and coupling a controller to said sensor array, said controller controls the gathering of the measurements.

30. The method of claim 29 further comprising the step of coupling a measurement storage unit to said controller.

31. The method of claim 29 wherein said sensor array further comprises an electrical impedance sensor array.

32. The method of claim 29 wherein said sensor array further comprises an electromagnetic sensor array.

33. The method of claim 29 wherein said sensor array further comprises a gamma ray sensor array.

34. The method of claim 29 wherein said sensor array further comprises an acoustic sensor array.

* * * * *